United States Patent [19]

Doerr

[11] 4,286,822

[45] Sep. 1, 1981

[54] UNDERSPOIL SLURRY HAULAGE

[75] Inventor: Richard E. Doerr, Ponca City, Okla.

[73] Assignee: Conoco, Inc., Ponca City, Okla.

[21] Appl. No.: 103,319

[22] Filed: Dec. 14, 1979

[51] Int. Cl.[3] ..... E21C 35/20; E21C 41/00

[52] U.S. Cl. ..... 299/18; 406/117; 299/19

[58] Field of Search ..... 299/18, 56, 57, 64, 299/19; 406/117

[56] References Cited

U.S. PATENT DOCUMENTS

| | | | |
|---|---|---|---|
| 4,143,922 | 3/1979 | Sweeney | 299/18 |
| 4,150,853 | 4/1979 | McCoy | 299/18 |

*Primary Examiner*—Ernest R. Purser

*Attorney, Agent, or Firm*—William J. Miller

[57] ABSTRACT

An improved mining method for a surface mine has pairs of slurry and water pipes placed from a processing area on the surface to the floor of the mine beneath the mined out material, pairs of pipes (slurry and water) are spaced along the mining trench. A slurry haulage system is connected to the water and slurry pipes at the beginning of the mining operation. As the mining progresses and the haulage system reaches its maximum capabilities, it is disconnected and connected to the next set of pipes and the first set or pair of pipes is extended the width of the mined trench. The overburden is placed on top of the pipes as the mining progresses.

3 Claims, 2 Drawing Figures

UNDERSPOIL SLURRY HAULAGE

BACKGROUND OF THE INVENTION

Hauling of material from a surface mine has always posed a problem. Normally trucks are used but the use of trucks leads to the construction of extensive roadways which results in minerals being left under the road. Furthermore, roads are expensive to build and maintain. Several systems have been proposed to eliminate the use of roads such as, for example, underspoil conveyors and underspoil truck haulage systems. Such systems are described in an article appearing in the publication "Coal Age", April 1976, pages 116–125. One problem, however, with both of the above systems is the extensive tunneling that must be constructed in order to support a pathway for trucks or a sheltered enclosure for a conveyor. Furthermore, such systems require ventilation since men and machines will be inside the tunnels. In the case of a truck or conveyor breakdown the entire passageway may be plugged for an extensive period of time necessitating the closure of the mine during that period of time.

BRIEF DESCRIPTION OF THE INVENTION

This invention discloses a unique use of a slurry haulage system wherein the slurry pipes are placed from the surface to the bed where the mineral has been removed. As mining progresses the slurry pipes are covered by the overburden. Several slurry pipes which include both water and slurry pipes are laid in pairs and spaced along the strip or trench being mined. When the slurry haulage system reaches the maximum length it can extend, it is disconnected and reconnected to the next adjacent pair of pipes. The previous pipes are then extended across the trench and temporarily plugged. As each set of pipes is used and disconnected it likewise is extended across the trench previously mined. When a new trench adjacent the old trench is begun to be mined, the first set of slurry pipes is uncovered and the slurry haulage system connected to it. The mining then progresses as it did with the first trench. When the mining is completed the slurry pipes are abandoned with only the surface connection being filled and plugged for safety purposes. The remainder of the pipe is well beneath the ground and should pose no hazard environmentally.

DETAILED DESCRIPTION OF THE INVENTION

Figure 1:
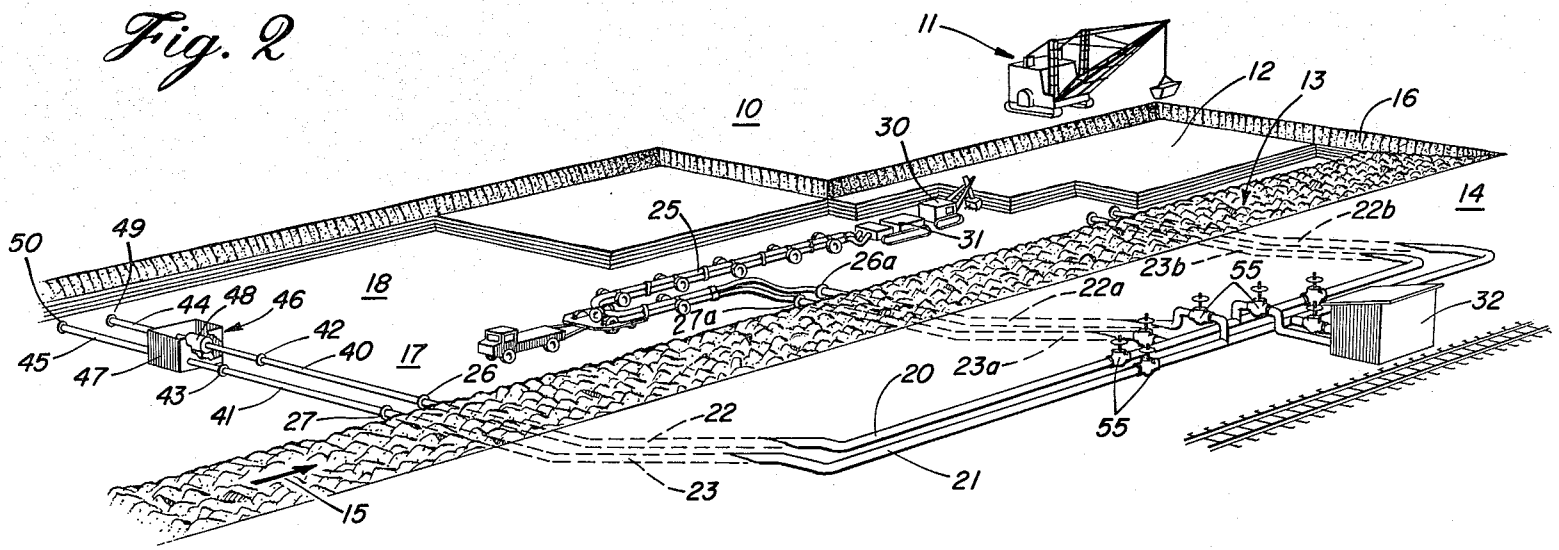
FIG. 1 shows a surface mining layout in the process of being mined with a slurry haulage system illustrating the invention and FIG. 2 shows an alternate method for connecting the slurry pipes illustrated in FIG. 1.

Referring to all the FIGURES, but in particular to FIG. 1, a surface mine is shown with part of the overburden removed and with the slurry pipes positioned in accordance with the invention. The overburden 10 is generally removed by a drag shovel 11 down to a mineral deposit 12 which is being mined for purposes which may, for example, be coal; however, other minerals near the surface could be mined in precisely the same manner. Generally in a mine of this type a first trench referred to by arrow 13 is dug by removing the overburden and depositing it on the ground at a location such as

14. The mine generally progresses in the direction of arrow 15 in the embodiment illustrated. Once the mining has progressed to face 16 a second strip or trench 17 is commensed. For illustrative purposes in describing the invention, a third strip 18 is illustrated as mined. Normally, however, 18 would not be mined until strip 17 is completed. The invention, however, is not limited to mining in single strips and is quite adaptable to more than one strip being mined at a time if the overburden can be properly disposed of in the interim. Normally once strip 13 is mined out bulldozers or other similar equipment will move the overburden onto the mined out area as illustrated so that reclamation of the land can progress. As described in the prior art, the mineral is generally removed by trucks and hauled to a disposal area for shipment or further processing such as washing, cleaning and separating of the coal from shale or other unburnable elements. Such processing is clearly known in the prior art and will not be further discussed.

In order to carry out the features of this invention, a pair of slurry pipes 20 and 21 are laid along the surface of the earth until a point where the pipes 22 and 23 are buried into the ground and sloping down to the floor of the mineral being mined. An area large enough to accommodate a slurry haulage system 25 is mined out and the system installed on the floor of the mine. Normally the haulage system would be connected to the terminous 26 and 27 of pipes 20 and 21, respectively. The slurry haulage system useful in the carrying out of this invention is well-known and already described in a U.S. Pat. No. 3,941,425 entitled "Mobile Slurry Handling System" by Eric H. Reichl. The mineral 12 is normally mined by a shovel 30 and deposited in a slurry hopper system 31 where the mineral is sized and mixed with water which is then pumped through one of the pipes 22 or 23 to a processing area 32 whereas in the prior art the coal is separated from the water and the coal processed in the usual manner. The water is returned to the mine and reused to form a slurry at hopper 31. Hopper 31 is also well-known and completely described in a U.S. Pat. No. 3,931,936 entitled "Apparatus for Crushing Solids in a Liquid Medium" by Eston F. Petry and Ronald W. Umphrey. Once mining has progressed past the point where the haulage system can extend it will be disconnected from the terminations 26 and 27 of pipes 22 and 23 and connected to pipes **22*a* and 23*a* at their terminous 26*a* and 27*a* as is illustrated in FIG. 1. Additional pipes 22*b* and 23*b* which have previously been laid will be utilized once the slurry haulage system has progressed to the point where it is fully extended. Once the slurry haulage system 25 is disconnected from the terminations 26 and 27 of pipes 22 and 23, extensions 40 and 41 are added to pipes 22 and 23, respectively, to the edge of the mined out section 17. Thus pipe extensions 40 and 41 would terminate at locations 42 and 43, respectively. The surrounding area around and over the pipes can be filled in with overburden as is illustrated in the previous strip 13. Continued mining such as strip 18 will result in added sections or extensions 44 and 45 to pipes 40 and 41, respectively. As the extensions are added it becomes necessary to boost the pressure in the pipes. To accomplish this, a boosting station generally referred to by arrow 46 can be set on the floor of the mined out area and, as illustrated in FIG. 1, may be a cement box 47. It could also be a circular metal enclosure or any suitable enclosure having strength sufficient to be surrounded by dirt and rock once the overburden is dumped around it. A suitable booster pump 48 can be mounted at the bottom of enclosure 47 or if desired the pipes can be extended to the top of the enclosure and the booster pump placed on the surface. As previously mentioned, pipes 44 and 45 will have some form of caps or closures 49 and 50, respectively, to prevent dirt, etc. from entering the pipe until a new strip is being cut. Suitable valves 55** can be incorporated to selectively operate whichever pipe is currently being utilized.

Figure 2:
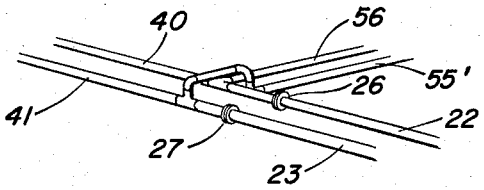

Referring to FIG. 2 an alternate method is shown instead of adding pipes 22*a* or 23*a*, a pair of pipes 55 and 56 can be added to pipes 22 and 23 and these pipes can be extended in the direction that the mining is progressing so that as the haulage system reaches the full distance it can be extended, sections 55' and 56 can be added having a length equal to the spacing between pipes 22 and 22*a*. Extensions 40 and 41 would similarly be added so that overburden could be placed on top of the slurry pipes. The system illustrated in FIG. 2 has a disadvantage that longer runs will be required for the slurry piping. Furthermore, additional bends or elbows will be required which normally have a higher wear problem. Also additional boosters will be required due to the additional length of the slurry piping system.

Once the area being mined is completed the booster pumps such as booster pump 48 is removed and the enclosure filled with dirt. Pipes 22 and 23 may be cut off below the surface and filled rendering the system compatible with most requirements for ecology. The above-described system has many advantages over the prior art. Slurry haulage systems are economical and safe. No tunnels are required which pose a problem both to men and equipment. No movement of materials is passing through tunnels which could result in plugging of tunnels in case of accident or stoppage of conveyors or trucks. Once the system is abandoned underspoil tunnels must be filled in in some manner or torn out. The weight of the overburden renders it virtually impossible to salvage the tunnels by removing them; therefore, they must be filled which is itself an expensive undertaking.

It is obvious that other arrangements of pipes would be required if a different mining system is utilized over that specifically disclosed and the invention is not so limited as to be specific to any particular mining method. It is also obvious that more than one face can be operated at one time and that under these conditions more than one haulage system can be incorporated.

It is obvious that modifications and changes can be made to the invention and still be within the spirit and scope of the invention as disclosed in the specification and appended claims.

What I claim is:

1. A method for underspoil haulage of mineral product from a surface mine wherein the top soil is removed which is covering the mineral layer and the area is continuously reclaimed over the mined out area comprising:

(a) removing a strip of overburden exposing the mineral layer thereunder;

(b) laying a first pair of pipes from the bottom of said mineral layer to a processing location;

(c) connecting a source of fluid to one of said pipes and a slurry processing system at said processing location to said remaining pipe;

(d) connecting a mobile slurry haulage system including a crusher and slurrying means to the termination of the pair of pipes at the bottom of said mineral layer;

(e) removing said mineral and depositing said mineral into said crusher and slurrying means to the maximum extent of said mobile slurry haulage system;

(f) laying a subsequent pair of pipes in the same manner as said first pair of pipes and reconnecting said slurry haulage system in the same manner as said first system;

(g) extending said first pair of pipes across the mined out strip;

(h) redepositing said strip of removed overburden over said mined out area including said first pair of pipes; and (i) repeating said steps to the end of said removed overburden.

2. In a surface mining operation wherein the overburden is removed in strips to expose the mineral being mined with the overburden as spoil being deposited in the mined out area a method for hauling the mineral from said mine comprising:

(a) spacing pairs of slurry pipes along said strip being mined with one end of said pair of pipes connected at the surface to a slurry processing system; with the other end terminating at the floor of said mine out area;

(b) connecting at least one of said pairs to a slurry haulage system including a hopper for mineral and a sizing apparatus to limit the maximum size of material being pumped through said slurry line;

(c) mining said mineral over an area to the extent permitted by said slurry haulage system then disconnecting said haulage system from said pair of pipe and reconnecting same to said next adjacent pipe;

(d) redepositing said removed overburden over said mined out area including said pair of pipes; and (e) extending said previously used pipe across the area where said mineral has been removed.

3. Method as described in claim 2 wherein a booster pump is connected into said slurry line.

* * * * *